United States Patent [19]

Wright

[11] Patent Number: 4,961,440

[45] Date of Patent: Oct. 9, 1990

[54] CHEMICAL DISPENSING APPARATUS

[75] Inventor: Philip H. Wright, Atherstone, England

[73] Assignee: Schering Agrochemicals Ltd., England

[21] Appl. No.: 374,440

[22] Filed: Jun. 30, 1989

[30] Foreign Application Priority Data

Jul. 2, 1988 [GB] United Kingdom ..... 8815787

[51] Int. Cl.[5] ..... B08B 3/02; B08B 9/08

[52] U.S. Cl. ..... 134/167 R; 134/170; 141/65; 222/85; 222/87; 222/148

[58] Field of Search ..... 134/62, 104.2, 167 R, 134/168 R, 170; 222/85, 87, 148; 141/65, 329, 330

[56] References Cited

U.S. PATENT DOCUMENTS

| | | | |
|---|---|---|---|
| 2,305,204 | 12/1942 | Smith | 222/85 X |
| 2,668,550 | 2/1954 | Burge | 134/62 |
| 3,993,221 | 11/1976 | Boynton et al. | 222/87 |
| 4,058,412 | 11/1977 | Knapp et al. | 134/104.2 X |
| 4,166,481 | 9/1979 | Farris et al. | 222/87 X |

FOREIGN PATENT DOCUMENTS

| | | | |
|---|---|---|---|
| 508339 | 1/1952 | Belgium | 134/170 |

*Primary Examiner*—Philip R. Coe

*Attorney, Agent, or Firm*—Osterlenk, Faber, Gerb & Soffen

[57] ABSTRACT

Chemical dispensing apparatus for emptying and rinsing containers of chemicals, with dilution of chemical. The apparatus includes a chamber in which the container can be enclosed and supported, draining means provided at a lower portion of said chamber and a hollow perforated wash pipe mounted on the chamber so as to be moveable into the interior thereof to pierce twice any container supported therein, the wash pipe being connected to a diluent supply. The chamber is provided with means for supporting the container in a generally tilted manner such that a corner thereof is presented as the lowest portion and the wash pipe is arranged to pierce the container through said corner, means being provided on the wash pipe to hold apart the lowest pierced portion of the container and one or more nozzles being provided to spray diluent over a substantial part of the interior of the container while the pierced portion is held apart.

12 Claims, 3 Drawing Sheets

CHEMICAL DISPENSING APPARATUS

The present invention relates to chemical dispensing apparatus for emptying and rinsing containers of chemicals and dispensing chemicals in diluted form.

Chemicals, particularly chemicals in the form of liquids, powders or granules for industrial or agricultural use, are often supplied in concentrated form and must be diluted before use. Furthermore, the chemicals are generally supplied in standard sizes of containers and the amount of a chemical required at any given instance may require several containers to be used. This is usually achieved by manually opening each container, emptying the contents into a suitable receptacle for dilution and rinsing the empty containers. The entire procedure is time consuming. When the chemicals used are corrosive and/or toxic, it is desirable to reduce the amount of personal contact during this operation, and protective clothing is often necessary.

U.S. Pat. No. 3,993,221 discloses a dispensing system for chemicals in which a container of chemical, usually a metal can of insecticide, is enclosed in a chamber and is pierced by a vertically moveable punch member to pierce the upper and lower walls thereof. The punch member is subsequently withdrawn allowing the contents to drain through the lower hole. The inside of the can is rinsed with water sprayed from the end of the punch member as it is withdrawn. The can is then crushed by a plunger to render it unsuitable for further use.

U.S. Pat. No. 4,058,412 discloses a dispensing system in which cans of liquids are emptied by being lowered into an angled support onto an upwardly projecting punch which pierces the can through its lowest corner. The punch is provided with passages to allow a drainage of liquid from the can and is also provided with a water spray to rinse the inside of the can.

It is an object of the present invention to provide apparatus for the automatic emptying and rinsing of chemical containers and dispensing the chemical in a suitably diluted form in as little time as possible. A further object is to provide such an apparatus which reduces the risk of exposure of the operator to the chemical, minimises the residual content of chemical in the container, and ensures the empty containers are unsuitable for re-use.

The present invention provides a chemical dispensing apparatus comprising a chamber in which a chemical container can be enclosed and supported, draining means provided at a lower portion of said chamber and a hollow perforated wash pipe mounted on said chamber so as to be moveable into the interior thereof to pierce twice any container supported therein, said wash pipe being connected to a diluent supply, characterised in that the chamber is provided with means for supporting the container in a generally tilted manner such that a corner thereof is presented as the lowest portion and the wash pipe is arranged to pierce the container through said corner, means being provided on the wash pipe to hold apart the lowest pierced portion of the container and one or more nozzles being provided to spray diluent over a substantial part of the interior of the container while the pieced portion is held apart.

The present invention has the advantage that the container is enclosed within a chamber when it is pierced, so reducing the likelihood of contact with the chemical, and the piercing operation may be followed immediately by rinsing without the need of withdrawal of the piercing member. The pierced wall of the container is held open to assist draining which is especially useful where viscous substances are being used and/or when the container is made of a plastics material. Due to its natural resilience, plastics material has a tendency partially or completely to seal any pierced holes, or to seal around a piercing member. Rinsing the container serves the double purpose of diluting the chemical and leaving the container clean for further handling and disposal. It is desirable that the residual content of chemical in the container is less than 0.01% to comply with safety regulations.

The pierced empty container is unsuitable for re-use, so avoiding the risk of its being re-filled with drinking water or other chemical and the consequent danger to public health is desirable.

Preferably, the chamber can accommodate several containers simultaneously, at least one wash pipe being provided for each container. Where large containers are used, two or more wash pipes, may pierce each container. It is particularly preferred that each container is arranged in the chamber such that its lowest point is a corner, the wash pipe being arranged to descend and pierce the surface of the container above said corner and also the surface at said corner to allow the contents to drain completely.

The wash pipe is conveniently mounted for axial sliding movement in the wall of the chamber. The axial movement is preferably achieved by a rack and pinion drive system, although any other drive mechanism allowing reciprocating sliding movement will suffice. Alternatively, the wash pipe may be mounted on the ends of an arm which is arranged for pivoting movement, the pipe describing an arc-like path.

The end of the wash pipe intended to pierce the container is suitably provided with a point or cutting edge. The wash pipe is preferably provided with slots or ridges, which serve the double function of holding apart the pierced wall of the container and providing channels to allow easy drainage from the container.

Where multiple wash pipes are present, these are preferably linked so that they may be moved together in parallel paths. The wash pipes are preferably connected to a common manifold for diluent supply.

The preferred diluent is water, although other diluents may be used if desired.

One or more additional spray means may be provided to enable the inside of the chamber and the outside of the container or containers to be washed. These suitably take the form of one or more spray nozzles mounted in the upper part of the chamber interior. The washing may take place simultaneously with the rinsing of the inside of the container(s), or subsequently. Following the dilution of the chemical and the rinsing of the interior of the container(s), the diluent may be changed for the purposes of, or to assist in, the washing action. In this event, the second diluent is preferably water.

The chamber is typically dimensioned so as to be able to accommodate various sizes of container. Where the chamber is designed to accommodate a plurality of containers, the chamber may include permanent or removable dividers to sub-divide the chamber into a plurality of chambers, each adapted to accommodate one or more containers.

Reference is made herein to containers and it will be understood that these will generally be substantially rigid containers (cans or drums) such as are conventionally used in agriculture or industry. However, many solid chemicals and some liquid chemicals, are now packaged in plastic bags or sachets. It has been found that the apparatus of the present invention may generally also be used for dispensing and diluting chemicals from such containers.

The present invention will now be described by way of example with reference to the accompanying drawings in which.

Figure 3:
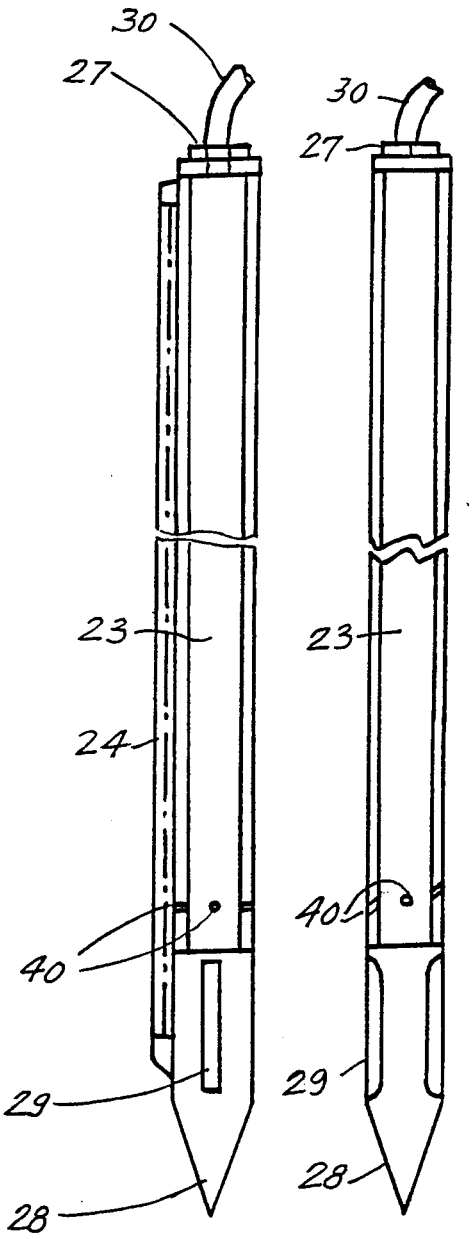
FIG. 3 is a front and side cross section of the wash pipes shown in FIGS. 1 and 2.
Figure 4:
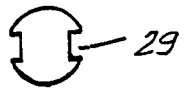
Figure 5:
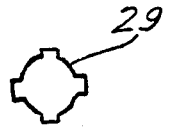

FIGS. 4 and 5 shown cross section views of alternative constructions of the lower end of wash pipe shown in FIG. 3.

Figure 6:
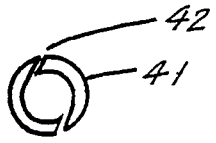
Figure 7:
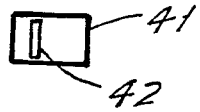

FIGS. 6 and 7 are respectively a diagrammatic cross section and side view of a collar containing spray jets for mounting on the wash pipe of FIG. 3 in place of the illustrated jets.

Figure 1:
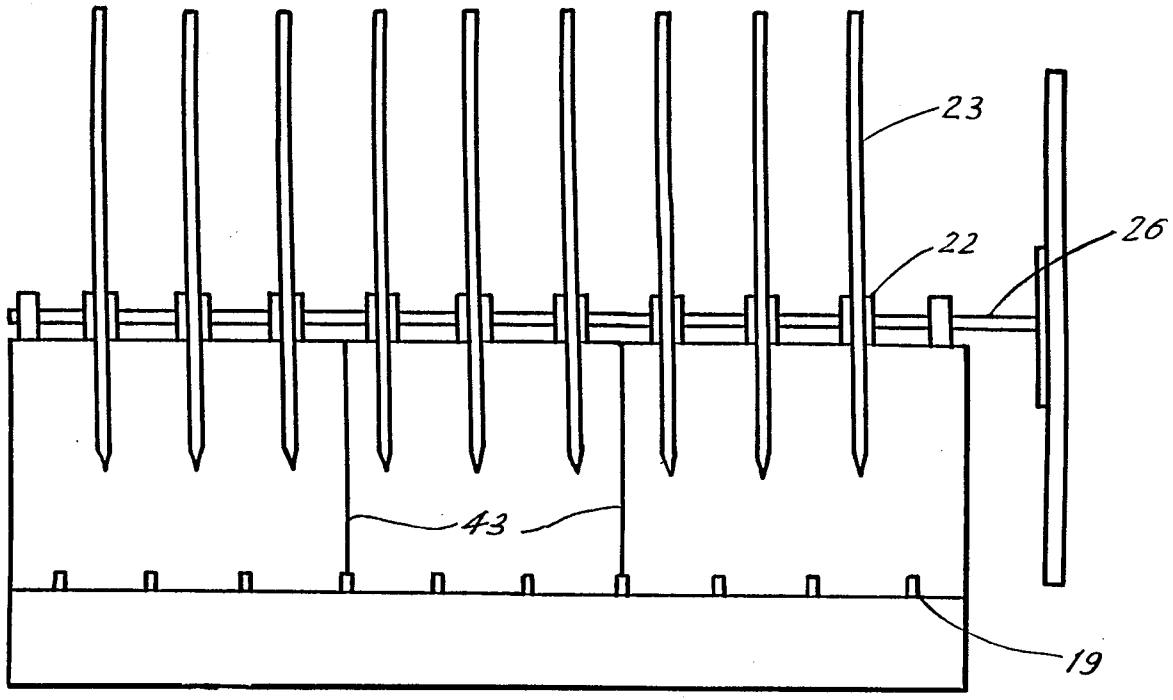
FIG. 1 is a diagrammatic sectioned front view of one embodiment of the present invention with parts omitted for clarity.
Figure 2:
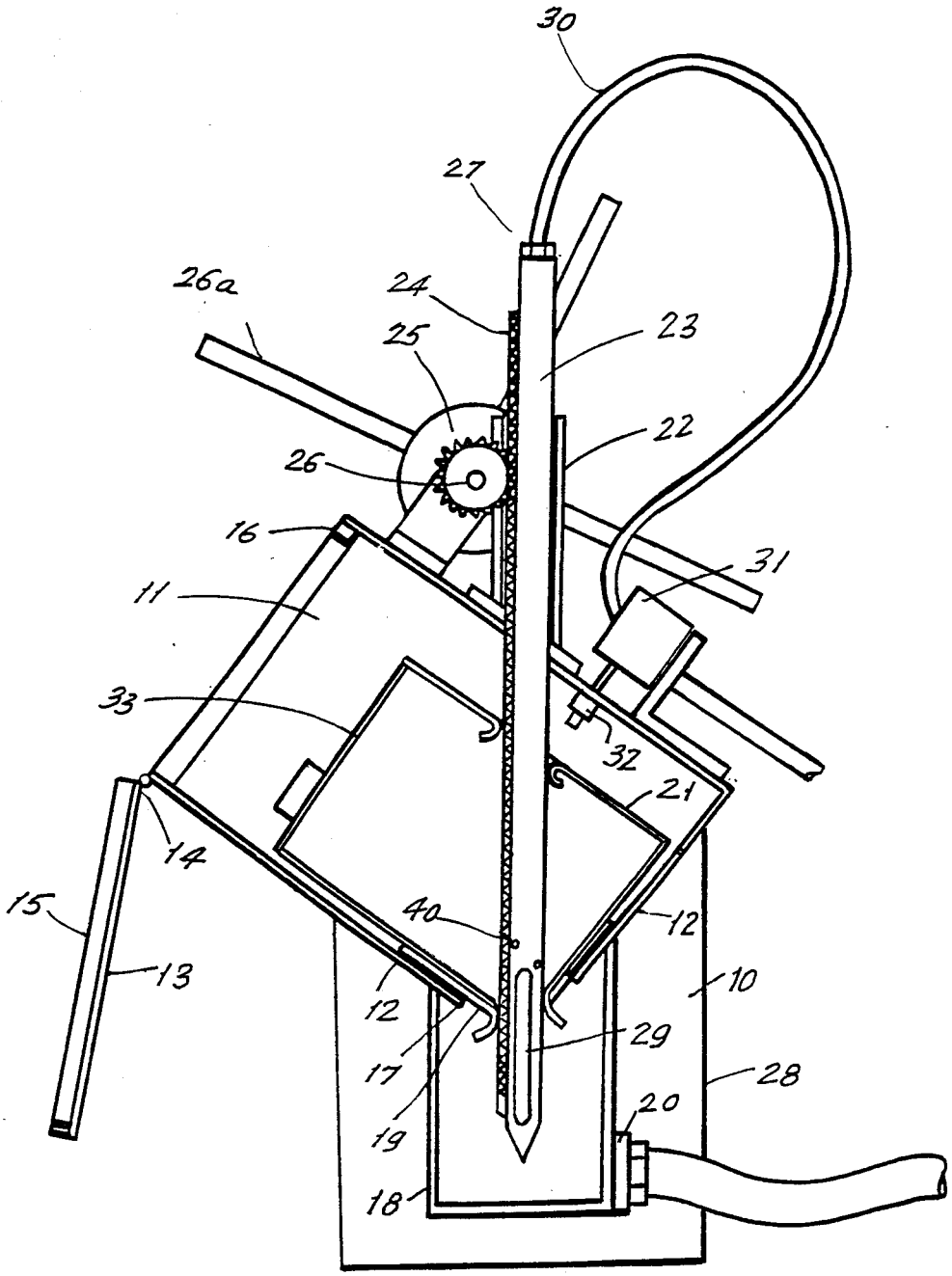
FIG. 2 is a diagrammatic sectioned side view of the embodiment shown in FIG. 1, showing a container (not part of the invention) mounted therein.

Referring now to FIGS. 1-3, the apparatus shown therein comprises a main chassis 10 including an elongate chamber 11. The chamber 11 comprises an elongate box suitably of metal or plastics material, and of generally rectangular cross section, supported on the chassis 10 such that the two lower sides 12 are at an angle of approximately 45 degrees to horizontal. The shorter other side comprises a cover 13 hinged along its lower edge 14 and provided with an inwardly projecting ridge 15 which engages in a corresponding slot 16 to form a seal. In an alterative embodiment the cover 13 is hinged about its upper edge.

The lowest edge of the chamber 11 is cut away to leave a drainage channel 17 beneath which is located an elongate drainage reservoir 18. The channel 17 is bridged at intervals by angled support bars 19, or in an alternative embodiment (not shown) by wire or plastic mesh supports. The drainage reservoir 18 is provided with an outlet 20 located at a lower portion thereof, through which the diluted chemical may be drained or dispensed.

The upper side 21 of the chamber 10 adjacent the cover 13 includes a plurality (in this case 9, although any suitable number could be used) of housings 22, in each of which is located an elongate wash pipe 23. The wash pipes 23 are arranged vertically in the housings so as to be slidable axially in the chamber 11 between a first position when only the lower portion of each wash pipe 23 extends into the chamber and a second position when the lower portion of each pipe 23 is positioned immediately below or in the drainage channel 17. In FIG. 2, the wash pipe 23 is shown in the second position. Movement of the wash pipes 23 between said two positions is achieved by a rack and pinion drive, comprising a rack 24 (suitably a gear rack or a chain) provided on each wash pipe 23 and engaging with a pinion 25 attached on each housing 22. The pinions 25 are connected to a common shaft 26 which can be rotated manually, for example by means of a capstan 26*a*. Alternatively, the pinions may be rotated by any suitable mechanical, hydraulic or electrical means. The common shaft 26 can be replaced by a pair of half shafts, each half shaft operating only half of the wash pipes. This permits sequential emptying of containers if required.

Each wash pipe 23 is hollow but is closed at both ends. An inlet aperture 27 is provided at the upper end and a pointed tip 28 is provided at the lower end. Four spray jets 40 are arranged radially around the wash pipe 23, two of said jets 40 spraying horizontally, one spraying above horizontal and one below horizontal. The number of spray jets can be varied according to requirements, the object being to direct jets of diluent over as large a portion of the inside surface of the container as possible. In an alternative embodiment illustrated in FIGS. 6 and 7, the spray jets 40 are replaced by a rotatably-mounted collar 41 incorporating tangential fan jets 42, to cause rotation of the collar during spraying of the diluent.

The pointed tip 28 is provided with grooves 29 on opposite sides thereof to facilitate drainage from chamber 11 into drainage reservoir 18. Alternative arrangements of grooves are shown in FIGS. 4 and 5.

The inlet aperture 27 of each pipe 23 is connected by a flexible hose 30 to a common diluent manifold 31 which can be connected to any suitable diluent supply. Optionally, spray heads 32 may be located in the upper portion of the chamber 11 and may also be connected directly to the manifold 31.

In an embodiment shown in FIG. 1, chamber 11 is provided with dividers 43, two dividers being shown in FIG. 1. Dividers may be provided between each pair or any pair or pairs of wash pipes 23, sub-dividing chamber 11 into up to 9 separate sub-chambers. The dividers 43 may be used to provide additional support for the containers 33, or to ensure physical separation of the containers until after dilution of the contents has been effected.

In use, the wash pipes 23 are moved to the first position, the cover 13 opened, and unopened containers 33 of the desired chemical or chemicals inserted into the chamber, typically one container beneath each pipe 23. The containers are positioned with one corner over the channel 17 supported on support bars 19. Cover 13 is closed and the pinion shaft 26 rotated to lower the wash pipes 23 to the second position as shown in FIG. 2. In one embodiment (not shown), a locking device is provided to prevent the lowering of the pipes 23 until the cover 13 is closed, further improving the safety of the apparatus.

During the lowering of the wash pipes 23, the pointed tips 28 penetrate the uppermost surface of the containers 33 and pas through the interior and the lower corner positioned over the channel 17. The contents of the container drain into channel 17 through the grooves 29, which in the case of a plastic container, prevent the container sealing around the tip 28 due to the natural resilience of the container material. Diluent is sprayed from the jets 40 to rinse the inside of the container and dilute the chemical in the reservoir 18. Simultaneously or subsequently, diluent is sprayed through the spray heads 32 to rinse the inside of the chamber 11 and the outside of container 33.

As soon as the containers are empty and the appropriate degree of dilution has been achieved, the reservoir can be emptied into a suitable receptacle such as the reservoir of an agricultural sprayer, or directly to the chemical metering system of a sprayer.

In a further embodiment, the entire operation is controlled by means of a mechanical or electrical programming device in order to effect all or part of the above sequence automatically. Such device may include one or more interlocking devices to improve the safety of the operation.

The empty containers may be removed before or after the emptying procedure. If desired, further full containers may be inserted into chamber 11 and the process repeated in order to add or mix in further chemical(s).

The apparatus illustrated above allows faster emptying of containers and dilution of the contents than is conventionally available. Personal contact with the chemicals is reduced to a minimum, and the interiors and exteriors of the containers are rinsed for safe handling and pierced so that they cannot be re-used.

I claim:

1. Chemical dispensing apparatus comprising a chamber in which a chemical container can be enclosed and supported, draining means provided at a lower portion of said chamber and a hollow perforated wash pipe mounted on said chamber so as to be moveable into the interior thereof to pierce twice any container supported therein, said wash pipe being connected to a diluent supply, characterised in that the chamber is provided with means for supporting the container in a generally tilted manner such that a corner thereof is presented as the lowest portion and the wash pipe is arranged to pierce the container through said corner, means being provided on the wash pipe to hold apart the lowest pierced portion of the container and one or more nozzles being provided to spray diluent over a substantial part of the interior of the container while the pierced portion is held apart.

2. Apparatus as claimed in claim 1, wherein the wash pipe is mounted generally vertically above the container and is moveable axially so as to pierce the container at the surface above said corner and the surface at said corner.

3. Apparatus as claimed in claim 1, in which a plurality of containers may be supported and wherein a plurality of wash pipes are provided, the wash pipes being linked such that all of said pipes move through the same distance.

4. Apparatus as claimed in claim 1, including permanent or removable dividers for sub-dividing the chamber.

5. Apparatus as claimed as in claim 1, wherein means are provided to allow diluent to be sprayed into the interior of the chamber as well as into the container.

6. Apparatus as claimed in claim 1, wherein the end of the wash pipe is configurated to provide channels through which the contents of the container can flow when the container is pierced.

7. Apparatus as claimed in claim 1, wherein the wash pipe is provided with means to hold apart at least a portion of the highest pierced portion of the container.

8. Apparatus as claimed in claim 7, wherein the wash pipe is mounted generally vertically above the container and is moveable axially so as to pierce the container at the surface above said corner and the surface at said corner.

9. Apparatus as claimed in claim 8, in which a plurality of containers may be supported and wherein a plurality of wash pipes are provided, the wash pipes being linked such that all said pipes move through the same distance.

10. Apparatus as claimed in claim 9, including permanent or removable dividers for subdividing the chamber.

11. Apparatus as claimed in claim 10, wherein means are provided to allow diluent to be sprayed into the interior of the chamber as well as into the container.

12. Apparatus as claimed in claim 11, wherein the end of the wash pipe is configurated to provide channels through which the contents of the container can flow when the container is pierced.

* * * * *